US009630806B2

(12) United States Patent
Wesson et al.

(10) Patent No.: US 9,630,806 B2
(45) Date of Patent: Apr. 25, 2017

(54) SHEAVE FOR AN ELEVATOR SYSTEM

(75) Inventors: John P. Wesson, Vernon, CT (US); Xiaomei Yu, Glastonbury, CT (US); David R. Polak, Glastonbury, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 82 days.

(21) Appl. No.: 14/401,267

(22) PCT Filed: May 16, 2012

(86) PCT No.: PCT/US2012/038049
§ 371 (c)(1),
(2), (4) Date: Nov. 14, 2014

(87) PCT Pub. No.: WO2013/172825
PCT Pub. Date: Nov. 21, 2013

(65) Prior Publication Data
US 2015/0129366 A1 May 14, 2015

(51) Int. Cl.
*B66B 15/04* (2006.01)

(52) U.S. Cl.
CPC ..... *B66B 15/04* (2013.01)

(58) Field of Classification Search
CPC ..... B66B 15/04; B66B 7/062
USPC ..... 187/266
See application file for complete search history.

(56) References Cited

U.S. PATENT DOCUMENTS 5,075,065 A * 12/1991 Effenberger ..... B29C 41/12 264/127
8,027,086 B2 9/2011 Guo et al.
2002/0129832 A1* 9/2002 Drzal ..... B08B 7/0057 134/1
2002/0139264 A1 10/2002 Bartscher et al.
2003/0068534 A1* 4/2003 Ohkawa ..... C08J 7/06 428/701
2004/0229043 A1* 11/2004 Spohn ..... B29C 41/32 428/421
2008/0156592 A1* 7/2008 Thompson ..... B29C 59/02 187/411
2009/0120731 A1* 5/2009 Thompson ..... B29C 47/0021 187/401
2010/0089262 A1* 4/2010 Seong ..... B41F 9/14 101/158
2010/0155988 A1 6/2010 Keil et al.
(Continued)

FOREIGN PATENT DOCUMENTS

JP 1014179 5/1998

OTHER PUBLICATIONS

International Search Report for application PCT/US20121038049, filed May 16, 2012, with a mailing date of Aug. 23, 2013, 5 pages.
(Continued)

*Primary Examiner* — Michael Riegelman
(74) *Attorney, Agent, or Firm* — Cantor Colburn LLP

(57) ABSTRACT

A method for constructing an interface between a sheave and a coated belt or rope of an elevator system, includes determining the surface energy of a surface of a coated belt or rope; and selecting a sheave such that the sheave has a work of adhesion between the coated belt or rope and the sheave, the work of adhesion meeting a defined relationship with a work of adhesion threshold.

17 Claims, 2 Drawing Sheets

(56) References Cited

U.S. PATENT DOCUMENTS

| | | | | |
|---|---|---|---|---|
| 2011/0100759 | A1* | 5/2011 | Yu | B66B 7/062 187/251 |
| 2011/0108371 | A1 | 5/2011 | Thompson et al. | |
| 2013/0207299 | A1* | 8/2013 | Mizoguchi | B29C 41/28 264/212 |
| 2013/0207300 | A1* | 8/2013 | Mizoguchi | B29C 41/28 264/212 |
| 2013/0270043 | A1* | 10/2013 | Wesson | B66B 7/062 187/251 |
| 2013/0292211 | A1* | 11/2013 | Polak | B66B 15/04 187/254 |
| 2015/0166307 | A1* | 6/2015 | Yu | B66B 15/04 254/390 |

OTHER PUBLICATIONS

Written Opinion for PCT/US2012/038049, filed May 16, 2012, with a mailing date of Aug. 23, 2013, 8 pages.

* cited by examiner

SHEAVE FOR AN ELEVATOR SYSTEM

FIELD OF INVENTION

The subject matter disclosed herein relates generally to the field of elevator systems and, more particularly, to a sheave and a method for constructing the sheave such that the surface energy of the sheave surface meets a predetermined surface energy threshold and/or the work of adhesion between the sheave and a belt or rope engaging the sheave meets a predetermined work of adhesion threshold.

DESCRIPTION OF RELATED ART

Traction elevator systems utilize lifting and/or suspending belts or ropes that are operably connected to an elevator car, and routed over one or more sheaves to propel the elevator along a hoistway. Coated belts or ropes, in particular, can include one or more cords within a jacket material. The cords could be formed from any suitable material such as steel or synthetic fiber, and could comprise a plurality of wires arranged into one or more strands and then arranged into the one or more cords.

Elevator systems typically utilize different types of sheaves. A traction or drive sheave is driven by an elevator propulsion device (also referred to as a machine) to impart motion to the elevator car. Sufficient traction at the traction sheave ensures that the belt moves along with the traction sheave during rotation of the traction sheave in order to achieve the desired movement of the elevator car and/or counterweight. Sufficient traction at the traction sheave also ensures that the belt does not move relative to the traction sheave when the traction sheave is not rotating in order to keep the elevator car at a desired position such as, for example, when the elevator car is at a landing. Elevator systems may also include one or more other sheaves, for example idler sheaves and deflector sheaves, that guide the belt around various components of the elevator system in a desired arrangement.

Over time, the belts may change their surface properties and alter the interaction between the belt and one or more sheaves. Interactions between the belt and the sheaves can result in impulsive noise when the work of adhesion exceeds a work of adhesion threshold. Above a work of adhesion threshold, shear energy stored in the belt jacket material is released in bursts as the belt slips as it passes over the sheave, which excites the belt and possibly other hoistway structures resulting in audible impulsive noise.

The undesired noise could travel through the air in the hoistway or vibration could travel along the belt and possibly to other components of the elevator system. Prior attempts to mitigate the noise have focused on reducing the coefficient of friction (COF) between the belt and the sheave surface. However, mitigating noise by limiting the COF is impractical since the COF can vary by the surface chemistry of belts and the age of the belt. Also, a small amount of interaction between the belt and the sheave by friction is desired so that frictional forces and the shape of the sheave generate the steering force to guide the belt on the sheave.

BRIEF SUMMARY

According to one aspect of the invention, a method for constructing an interface between a sheave and a coated belt or rope of an elevator system, includes determining the surface energy of a surface of the coated belt or rope; and selecting a sheave such that the work of adhesion between the coated belt or rope and the sheave has a defined relationship with a work of adhesion threshold.

Additionally or alternatively, the work of adhesion is less than a work of adhesion threshold of about 85 $mJ/m^2$.

Additionally or alternatively, the work of adhesion is within a work of adhesion threshold range of about 30 $mJ/m^2$ to about 85 $mJ/m^2$.

Additionally or alternatively, the work of adhesion is greater than a work of adhesion threshold of about 45 $mJ/m^2$.

Additionally or alternatively, the sheave surface of the sheave satisfies the following equations:

$$\gamma=\gamma^d+\gamma^p; \text{ and}$$

$$Wa=2(\sqrt{\gamma_{belt}{}^d\gamma_{sheave}{}^d}+\sqrt{\gamma_{belt}{}^p\gamma_{sheave}{}^p});$$

wherein $\gamma$, $\gamma^d$ and $\gamma^p$ represent the total surface energy, dispersive surface energy, and polar surface energy respectively; and Wa represents the work of adhesion.

Additionally or alternatively, the sheave surface has a coating material thereon selected from the group consisting of polytetrafluoroethylene, polystyrene, ethylene tetrafluoroethylene, and perfluoroalkoxy.

Additionally or alternatively, the sheave is one of an idler sheave and a deflector sheave.

Additionally or alternatively, the sheave is a traction sheave.

Additionally or alternatively, the selecting ensures the work of adhesion has the defined relationship with the work of adhesion threshold throughout the life of the sheave in the elevator system.

Additionally or alternatively, the selecting ensures the work of adhesion has the defined relationship with the work of adhesion threshold at initial installation of the sheave in the elevator system.

According to another aspect of the invention, a method for constructing a sheave of an elevator system includes determining a surface energy of a surface of the sheave that engages a coated belt or rope; and selecting a sheave such that the sheave has a surface energy having a defined relationship with a surface energy threshold.

Additionally or alternatively, the surface energy is within a surface energy threshold range of about 20 $mJ/m^2$ to about 45 $mJ/m^2$.

Additionally or alternatively, the method includes coating the sheave with a coating material, wherein the coating material is selected from the group consisting of polytetrafluoroethylene, polystyrene, ethylene tetrafluoroethylene, and perfluoroalkoxy.

Additionally or alternatively, the sheave is one of an idler sheave and a deflector sheave.

Additionally or alternatively, the sheave is a traction sheave.

Additionally or alternatively, the selecting ensures the surface energy has the defined relationship with the surface energy threshold throughout the life of the sheave in the elevator system.

Additionally or alternatively, the selecting ensures the surface energy has the defined relationship with the surface energy threshold at initial installation of the sheave in the elevator system.

According to another aspect of the invention, a sheave in an elevator system that engages a coated belt or rope includes a surface for engaging the coated belt or rope; wherein the surface has a surface energy having a defined relationship with a surface energy threshold.

Additionally or alternatively, the surface energy is within a surface energy threshold range of about 20 $mJ/m^2$ to about 45 $mJ/m^2$.

Additionally or alternatively, the surface of the sheave includes a coating that satisfies the following equations:

$$\gamma=\gamma^d+\gamma^p; \text{ and}$$

$$Wa=2(\sqrt{\gamma_{belt}{}^d\gamma_{sheave}{}^d}+\sqrt{\gamma_{belt}{}^p\gamma_{sheave}{}^p});$$

wherein $\gamma$, $\gamma^d$, and $\gamma^p$ represent the total surface energy, dispersive surface energy, and polar surface energy respectively; and Wa represents the work of adhesion.

Additionally or alternatively, the coating is selected from the group consisting of polytetrafluoroethylene, polystyrene, ethylene tetrafluoroethylene, and perfluoroalkoxy.

Additionally or alternatively, the sheave is one an idler sheave and a deflector sheave.

Additionally or alternatively, the sheave is a traction sheave.

Additionally or alternatively, the sheave has the defined relationship with the surface energy threshold throughout the life of the sheave in the elevator system.

Additionally or alternatively, the sheave has the defined relationship with the surface energy threshold at initial installation of the sheave in the elevator system.

According to another aspect of the invention, an assembly for an elevator system includes a coated belt or rope; and a sheave, comprising a surface for engaging the coated belt or rope; wherein the surface of the sheave and the coated belt or rope have a work of adhesion between the coated belt or rope and the sheave, the work of adhesion having a defined relationship with a work of adhesion threshold.

Additionally or alternatively, the work of adhesion is less than a work of adhesion threshold of about 85 $mJ/m^2$.

Additionally or alternatively, the work of adhesion is within a work of adhesion threshold range of about 30 $mJ/m^2$ to about 85 $mJ/m^2$.

Additionally or alternatively, the work of adhesion is greater than a work of adhesion threshold of about 45 $mJ/m^2$.

Additionally or alternatively, the sheave is one of an idler sheave and a deflector sheave.

Additionally or alternatively, the sheave is a traction sheave.

Additionally or alternatively, the work of adhesion between the coated belt or rope and the sheave has the defined relationship with the work of adhesion threshold throughout the life of the sheave in the elevator system.

Additionally or alternatively, the work of adhesion between the coated belt or rope and the sheave has the defined relationship with the work of adhesion threshold at initial installation of the coated belt or rope and sheave in the elevator system.

Other aspects, features, and techniques of the invention will become more apparent from the following description taken in conjunction with the drawings.

BRIEF DESCRIPTION OF THE SEVERAL VIEWS OF THE DRAWINGS

The subject matter which is regarded as the invention is particularly pointed out and distinctly claimed in the claims at the conclusion of the specification. The foregoing and other features, and advantages of the invention are apparent from the following detailed description taken in conjunction with the accompanying drawings in which:

DETAILED DESCRIPTION

Embodiments include a method for selecting a surface of a sheave that provides a surface energy that satisfies a surface energy threshold and/or provides a work of adhesion (Wa) between the sheave and a coated belt or rope that satisfies a work of adhesion threshold. In embodiments, the range of surface energies for new and used belts may be determined by measurements. In one embodiment, the worst case surface energy of the belt is defined and used as an upper limit for the selection of the sheave. Further, the sheave is selected such that the surface energy of the sheave surface does not exceed a predetermined surface energy threshold and/or the Wa between the coated belt or rope and the sheave does not exceed a predetermined work of adhesion threshold. Exceeding the threshold for the surface energy of the sheave and/or the threshold for the Wa between the coated belt or rope and sheave could generate impulsive noise, which is released as airborne noise or as vibration into the system. The sheave may be selected such that the Wa between the coated belt or rope and the sheave exceeds a predetermined work of adhesion threshold to provide suitable traction. Other embodiments include a process for measuring the Wa between the belt and the sheave and defining an acceptable limit for the surface energies of new or aged belts for a given sheave such that the interaction between the belt and the sheave is below the predetermined maximum Wa threshold. Other embodiments include a method for specifying the surface energy of the sheave surface and determining an allowable surface energy range for a sheave.

Figure 1:
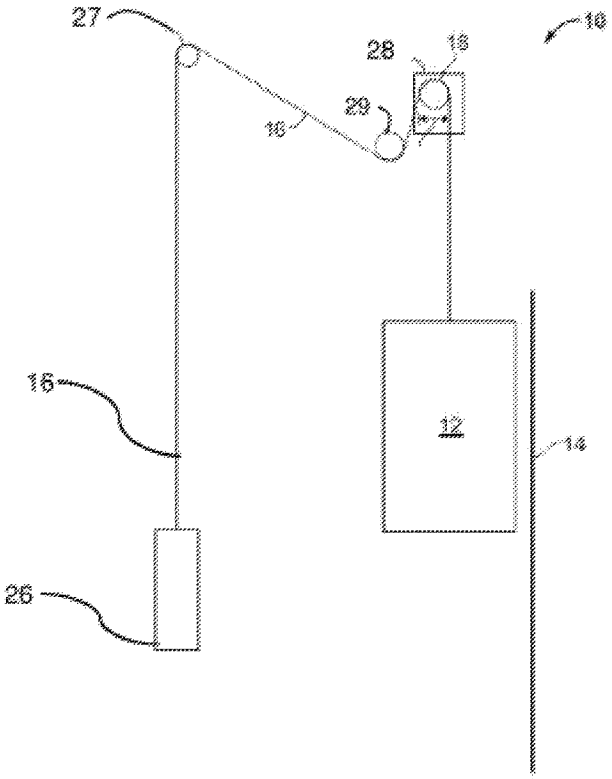
FIG. 1 Prior Art
FIG. 1 schematically shows selected portions of an example elevator system including at least one sheave designed according to an embodiment of this invention.

FIG. 1 illustrates a schematic of an example elevator system 10 including one or more lifting and/or suspending belts or ropes, such as coated belts or ropes in the form of coated steel belts 16. Although embodiments of the present invention are useable with any lifting and/or suspending belt or rope, the following description will be made with reference to a coated steel belt. It is to be appreciated that the system can also be used with other sheave arrangements such as a sheave that accepts a poly-V belt, a coated round rope, an oval belt, or the like.

Elevator system 10 includes an elevator car 12 operatively suspended or supported in a hoistway 14 with one or more belts 16. The one or more belts 16 are routed around the various components of the elevator system 10 by interacting with a traction sheave 18 and idler sheaves 20, 22, 24. The one or more belts 16 may also be connected to a counterweight 26, which is used to help balance the elevator system 10 and reduce the difference in belt tension on both sides of the traction sheave 18 during operation. The one or more belts 16 support the weight of the car 12 and the counterweight 26 in a known manner.

Traction sheave 18 is driven by a machine 28. Movement of traction sheave 18 by the machine 28 drives, moves and/or propels (through traction) the one or more belts 16 that are routed around the traction sheave 18 and the plurality of idler sheaves 20, 22, 24. One or more of the idler sheaves 20, 22, 24 may have a convex shape or crown along its axis of rotation to assist in keeping the one or more belts 16 centered, or in a desired position, along the idler sheaves 20, 22, 24. Traction sheave 18 experiences unbalanced belt tension across the sheave, whereas idler sheaves 20, 22 and 24 experience balanced belt tension across the sheaves.

Figure 2:
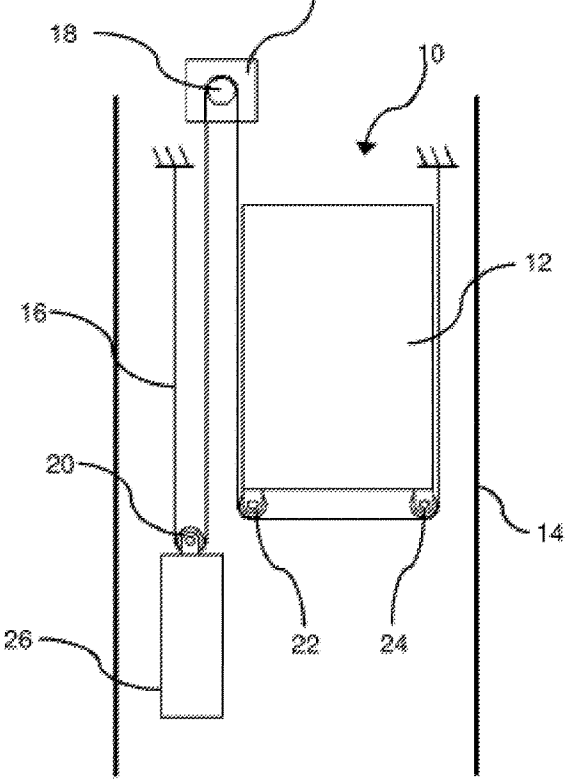
FIG. 2 Prior Art
FIG. 2 schematically shows selected portions of an another example elevator system including at least one sheave designed according to an embodiment of this invention.

FIG. 2 illustrates a schematic of an example elevator system 10 in an alternate embodiment. FIG. 2 depicts traction sheave 18 and deflector sheaves 27 and 29. Deflector sheaves 27, 29 are similar to idler sheaves 20, 22, 24 in that the deflector sheaves are not driven by machine 28. Deflector sheaves 27, 29, however, are stationary and do not move as car 12 moves.

One or more of the sheaves 18, 20, 22, 24, 27, 29 may have a surface that provides a desired work of adhesion between the sheave(s) and the one or more belts 16. Sheaves 18, 20, 22, 24, 27, 29 may accommodate a wide range of surface energies on the belts 16 without introducing undesired noise and/or compromising the necessary friction or traction between the sheave and the one or more belts 16.

Figure 3:
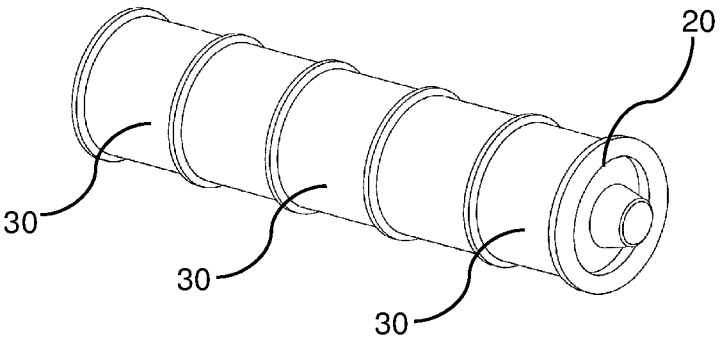
FIG. 3 is a perspective illustration of an example sheave according to an embodiment of the invention.

FIG. 3 shows an exemplary embodiment of a sheave, such as an idler sheave 20, which is constructed to provide desired noise resistant characteristics when used with new or aged belts. In an example, the idler sheave 20, which can include a plurality of sheave surfaces 30 that could be substantially similar, is constructed to have a surface energy meeting a surface energy threshold and/or a resulting work of adhesion Wa between the sheave 20 and the belt 16 that meets a work of adhesion threshold. The surface energy is generally defined as a measure of the work required to create a new surface of a given material. As described in detail herein, the surface energy of a sheave and the surface energy of the belt combine to define the work of adhesion. By selecting the surface energy of the sheave, the resultant work of adhesion can be controlled, even as a belt ages Under normal expected operation the sheave surface is expected to see wear and oxidation and the selected coating is expected to maintain a surface energy below 85 milliJoules per square meter (mJ/m$^2$) over an expected lifetime of at least 2 years with wear such that the base sheave material is not observable to the unaided eye. A preferred surface is expected to maintain a surface energy below 85 milliJoules per square meter (mJ/m$^2$) over an expected lifetime of at least 5 years with wear such that the base sheave material is not observable to the unaided eye. In examples where the base and surface materials are the same, wear would result in no observable pitting when observed by the unaided eye.

The work of adhesion (Wa) is a measure of the attraction between the sheave surface 30 and a surface of the belt 16 that engages the sheave surface 30. In other words, it is the work required (per unit area) to create two new surfaces when two different materials, for example sheave 20 and belt 16 are separated. As such, Wa is a function of the surface energies of the belt 16 and sheave 20.

In an embodiment, the sheave surface of an idler sheave 20, 22, 24 or a deflector sheave 27, 29 has a surface energy selected such that the Wa between the sheave and belt is defined to be below a predetermined maximum threshold value of about 85 milliJoules per square meter (mJ/m$^2$). This reduces noise characteristics and provides a more robust elevator system. In other embodiments, Wa is in a range of about 30 mJ/m$^2$ to about 85 mJ/m$^2$ (i.e., 30<=Wa<=85). It is to be appreciated that the predetermined maximum threshold of Wa (or range of values) can be defined for the entire life of the sheave and belt interaction, or for a shorter period, such as upon initial installation.

In another embodiment, the sheave surface of a traction sheave 18 has a surface energy such that the Wa between the sheave and belt is defined to be above a predetermined minimum threshold value. In an embodiment, Wa between the traction sheave 18 and belt 16 is above a predetermined minimum threshold value of about 45 mJ/m$^2$. The surface energy of the traction sheave is selected so as to provide sufficient Wa between traction sheave 18 and belt 16 so as to adequately propel the belt. The upper limit of the surface energy of the traction sheave can be selected such that unwanted noise and vibration in the elevator system is reduced or prevented. In one embodiment, the present invention ensures the desired work of adhesion value (or range of values) throughout the life of the sheave in the elevator system. Alternatively, the desired work of adhesion value (or range of values) may be defined at installation of the sheave in the elevator system.

In an embodiment, the sheave surface 30 may be coated with polymer materials that define the surface energy characteristics and/or keep the resulting Wa at a desired level or range of levels. In some examples, belt 16 may be a new or aged polyurethane belt having a predetermined surface energy which is measured according to known methods, although in other non-limiting examples, belt 16 can be made from other materials, like synthetic rubber such as, for example, polyester urethane, ethylene propylene diene monomer (EPDM) rubber, Acrylonitrile Butadiene, Acrylonitrile Butadiene Carboxy Monomer, or other similar synthetic rubbers, without departing from the scope of the invention. The surface energies of new or aged belts are measured by measuring the contact angle of the belts with, in one example, a ramé-hart surface energy Goniometer 500 . With the new and aged belt surface energy measurements, the sheave surface 30 is constructed by coating or depositing materials having a known surface energy on the sheave so as to keep the resulting Wa between the belt and the sheave surface at a desired level or within a range of levels. Exemplary coatings that may be applied to surface 30 to achieve the desire surface energy include polytetrafluoroethylene, polystyrene, ethylene tetrafluoroethylene, and perfluoroalkoxy. Other coatings, such as ceramics, metals and other non-polymer coatings, may be used on surface 30 to provide the desired surface energy. As such, embodiments are not limited to polymer coatings.

To establish the surface energy for surface 30, the polar surface energy ($\gamma^p$) ) and dispersive surface energy ($\gamma^d$) are measured for a new belt 16 and after accelerated aging of the belt 16. If multiple belt types are utilized, then the surface energies would be measured for all new and aged belts, prior to defining Wa and determining a range of surface energy for the sheaves. In one example, the ASTM D7490-08 Standard Test Method for Measurement of the Surface Tension of Sold Coatings, Substrates and Pigments specified by ASTM International can be used for surface energy estimation of the belt 16. The surface energy of a sheave can then be set to a value that yields the desired Wa between the sheave and the belt. An example of an instrument used to measure surface energy by measuring wetting angle of polar and non-polar droplets is a Rame-Hart Model 500-F1 Advanced Goniometer.

In the example of an idler sheave or a deflector sheave, sheave surface 30 is constructed with a surface energy so that the Wa between the sheave and the belt is less than a work of adhesion threshold of 85 mJ/m$^2$, in exemplary embodiments. In another example of an idler sheave or a deflector sheave, sheave surface 30 is constructed with a surface energy so that the Wa between the sheave and the belt is between work of adhesion thresholds of about 30 $mJ/m^2$ to about 85 $mJ/m^2$, in exemplary embodiments. For an idler sheave or deflector sheave, the sheave surface may be constructed to provide a surface energy less than a surface energy threshold of about 45 $mJ/m^2$, in exemplary embodiments. Further, the surface of the idler sheave or deflector sheave may be constructed to provide a surface energy between surface energy thresholds of about 20 $mJ/m^2$ to about 45 $mJ/m^2$, in exemplary embodiments. As noted above, the surface energy of the sheave surface 30 is controlled through sheave material selection and/or sheave coatings.

In the example of a traction sheave, the sheave surface 30 is constructed with a surface energy so that the Wa between the belt and the sheave is greater than a work of adhesion threshold of about 45 $mJ/m^2$, in exemplary embodiments. As noted above, the surface energy of the sheave surface 30 is controlled through sheave material selection and/or sheave coatings.

In one example, an aged belt with a predictably worst case surface energy is measured and a sheave surface 30 is constructed with materials and/or coatings to define the Wa according to the following equations:

$$F_{friction}=F_{adhesion}+F_{deformation} \quad (1);$$

$$F_{adhesion}\sim\zeta_{ad}*A \quad (2);$$

$$\gamma=\gamma^d+\gamma^p \quad (3)$$

Where:

$F_{friction}$=total friction force $F_{adhesion}$=adhesive friction force $F_{deformation}$=friction due to surface deformation $\zeta_{ad}$=adhesive shear stress A=contact area between the surface of belt 16 and surface of the sheave 20;

$\gamma$=surface energy;

$\gamma^d$=dispersive surface energy;

$\gamma^p$=polar surface energy.

Wa is calculated for the interaction of the sheave surface 30 with the belt surface using equation 4 below:

$$\zeta_{ad}\sim Wa=2(\sqrt{\gamma_{belt}{}^d\gamma_{sheave}{}^d}+\sqrt{\gamma_{belt}{}^p\gamma_{sheave}{}^p}) \quad (4)$$

As expressed by equation 4, the work of adhesion Wa between two surfaces can be determined mathematically using experimentally-obtained surface energy measurements of each surface, such as the surface 30 of a sheave and belt 16. In one example, the work of adhesion can be calculated by using the principles described in the publication authored by Bismarck et al. titled "Study on surface and mechanical fiber characteristics and their effect in the adhesion properties to a polycarbonate matrix tuned by anodic carbon fiber oxidation", which is herein incorporated by reference. Both dispersive and polar energies are measured for both sheave surface 30 and the surface of belt 16, and Wa is calculated using these values in equation 4 . With increasing Wa, more shear energy is stored in the jacket material of the belt 16, and it is released impulsively, resulting in excitation pulses or events with larger amplitudes. Above a critical work of adhesion threshold these pulses result in audible noise.

In other examples, belts used in elevator system 10 do not generate an undesirable impulsive noise if the Wa between the sheave surface and the belt is kept below the maximum work of adhesion threshold of about 85 $mJ/m^2$. From the measured surface energies of aged belts whose ranges measure approximately 40-45 $mJ/m^2$, the surface energy of a theoretical worst case belt having a surface energy of 45 $mJ/m^2$ (for example, 15 polar surface energy and 30 dispersive surface energy) may be used to calculate the upper limit of surface energy for an idler sheave surface 30 in order to limit the Wa below about 85 $mJ/m^2$. It is to be appreciated that a surface energy of aged belts and sheave surface 30, which results in a Wa exceeding 85 $mJ/m^2$, causes an excitation and/or impulse in the system 10 from the shear or strain energy that builds and eventually releases as noise.

For example, a typical used sheave surface 30 was measured to have a surface energy of 54 $mJ/m^2$ (i.e., 21 polar, 33 dispersive). Using the foregoing equation (4), the Wa is calculated as:

$$Wa=2(\sqrt{30*33}+\sqrt{15*21})=2(31.5+17.7)=98.4\ mJ/m^2$$

According to the aforementioned discussion, an increased Wa causes more shear energy to be stored in the jacket material, and to release the energy impulsively. A sheave surface and belt with a Wa of 98.4 $mJ/m^2$ may generate impulsive noise. In an embodiment, the sheave surface 30 would be coated to define a predetermined surface energy that results in Wa between the sheave and the belt to be below about 85 $mJ/m^2$ and prevent the aforementioned impulsive noise. In another embodiment, an approximated ratio between polar and dispersive energies for a sheave surface 30 of about 1:2 would set an upper limit on the surface energy of the sheave surface of 42 $mJ/m^2$ (i.e., 14 polar surface energy and 28 dispersive surface energy). But, since the ratios of polar and dispersive energies for different materials can vary, this is an approximation.

The technical effects and benefits of exemplary embodiments include a method for selecting sheave material and/or materials for deposition on a sheave surface in order to define the surface energy of the sheave surface to meet applicable surface energy threshold(s) and/or provide a work of adhesion Wa between the sheave and belt meeting applicable work of adhesion threshold(s). Embodiments include a process for measuring the surface interaction between the belt and the sheave and defining acceptable thresholds for new or aged belts that meet the requirements of work of adhesion thresholds. Embodiments also include a method for specifying and identifying belt and/or sheave materials to provide a Wa meeting applicable work of adhesion threshold (s).

The terminology used herein is for the purpose of describing particular embodiments only and is not intended to be limiting of the invention. While the description of the present invention has been presented for purposes of illustration and description, it is not intended to be exhaustive or limited to the invention in the form disclosed. Many modifications, variations, alterations, substitutions, or equivalent arrangement not hereto described will be apparent to those of ordinary skill in the art without departing from the scope and spirit of the invention. Additionally, while various embodiments of the invention have been described, it is to be understood that aspects of the invention may include only some of the described embodiments. Accordingly, the invention is not to be seen as limited by the foregoing description, but is only limited by the scope of the appended claims.

The invention claimed is:

1. A method for constructing an interface between a sheave and a coated belt or rope of an elevator system, comprising:

selecting the sheave such that a work of adhesion between the coated belt or rope and the sheave has a defined relationship with a work of adhesion threshold to reduce noise;

wherein a sheave surface of the sheave satisfies the following equations:

$$\gamma=\gamma^d+\gamma^p; \text{ and}$$

$$Wa=2(YdbeltYdsheave+YpbeltYpsheave)$$

wherein Y, Yd and Yp represent total surface energy, dispersive surface energy, and polar surface energy respectively; and Wa represents the work of adhesion.

2. The method of claim 1, wherein the work of adhesion threshold is about 85 mJ/m2, the work of adhesion is less than the work of adhesion threshold.

3. The method of claim 2, wherein the work of adhesion threshold comprises a work of adhesion threshold range of about 30 mJ/m2 to about 85 mJ/m2, the work of adhesion is within the work of adhesion threshold range.

4. The method of claim 2, wherein the sheave is one of an idler sheave and a deflector sheave.

5. The method of claim 1, wherein the work of adhesion threshold is about 45 mJ/m2, the work of adhesion is greater than the work of adhesion threshold.

6. The method of claim 5, wherein the sheave is a traction sheave.

7. The method of claim 1 wherein the sheave surface has a coating material thereon selected from a group consisting of polytetrafluoroethylene, polystyrene, ethylene tetrafluoroethylene, and perfluoroalkoxy.

8. The method of claim 1, wherein the selecting ensures the work of adhesion has the defined relationship with the work of adhesion threshold throughout the life of the sheave in the elevator system.

9. The method of claim 1, wherein the selecting ensures the work of adhesion has the defined relationship with the work of adhesion threshold at initial installation of the sheave in the elevator system.

10. The method of claim 1, wherein the work of adhesion threshold is about 45 mJ/m2, the work of adhesion is greater than the work of adhesion threshold.

11. The assembly of claim 10, wherein the sheave is a traction sheave.

12. An assembly for an elevator system, comprising:

a coated belt or rope; and a sheave, comprising:

a surface for engaging the coated belt or rope;

wherein the surface of the sheave and the coated belt or rope have a work of adhesion between the coated belt or rope and the sheave, the work of adhesion having a defined relationship with a predetermined work of adhesion threshold to reduce noise.

13. The assembly of claim 12, wherein the work of adhesion threshold is about 85 mJ/m2, the work of adhesion is less than the work of adhesion threshold.

14. The assembly of claim 13, wherein the work of adhesion threshold comprises a work of adhesion threshold range of about 30 mJ/m2 to about 85 mJ/m2, the work of adhesion is within the work of adhesion threshold range.

15. The assembly of claim 13, wherein the sheave is one of an idler sheave and a deflector sheave.

16. The assembly of claims 12, wherein the work of adhesion between the coated belt or rope and the sheave has the defined relationship with the work of adhesion threshold throughout the life of the sheave in the elevator system.

17. The assembly of claims 12, wherein the work of adhesion between the coated belt or rope and the sheave has the defined relationship with the work of adhesion threshold at initial installation of the coated belt or rope and sheave in the elevator system.

* * * * *